US011554844B2

(12) United States Patent
Koyama

(10) Patent No.: US 11,554,844 B2
(45) Date of Patent: Jan. 17, 2023

(54) PLANING BOAT

(71) Applicant: YANMAR POWER TECHNOLOGY CO., LTD., Osaka (JP)

(72) Inventor: Hiroyuki Koyama, Osaka (JP)

(73) Assignee: YANMAR POWER TECHNOLOGY CO., LTD., Osaka (JP)

( * ) Notice: Subject to any disclaimer, the term of this patent is extended or adjusted under 35 U.S.C. 154(b) by 0 days.

(21) Appl. No.: 16/967,958

(22) PCT Filed: Jan. 9, 2019

(86) PCT No.: PCT/JP2019/000316
§ 371 (c)(1),
(2) Date: Aug. 6, 2020

(87) PCT Pub. No.: WO2019/167432
PCT Pub. Date: Sep. 6, 2019

(65) Prior Publication Data

US 2021/0031895 A1 Feb. 4, 2021

(30) Foreign Application Priority Data

Feb. 27, 2018 (JP) ..... JP2018-032681

(51) Int. Cl.
*B63H 25/42* (2006.01)
*B63B 1/18* (2006.01)
(Continued)

(52) U.S. Cl.
CPC ..... *B63H 25/42* (2013.01); *B63B 1/18* (2013.01); *B63H 1/12* (2013.01); *B63H 25/04* (2013.01);
(Continued)

(58) Field of Classification Search
CPC ..... B63H 25/42; B63H 1/12; B63H 25/04; B63H 2001/122; B63B 1/18
See application file for complete search history.

(56) References Cited

U.S. PATENT DOCUMENTS 2,058,383 A * 10/1936 Maynes ..... B63B 1/041 114/62
4,367,689 A * 1/1983 Lukehart ..... B63B 1/041 440/6
(Continued)

FOREIGN PATENT DOCUMENTS

JP 2000-053092 A 2/2000
JP 2005-008116 A 1/2005
(Continued)

OTHER PUBLICATIONS

International Search Report and Written Opinion for PCT Patent App. No. PCT/JP2019/000316 (dated Apr. 2, 2019) with English language translation of the ISR.

*Primary Examiner* — Andrew Polay
(74) *Attorney, Agent, or Firm* — Cermak Nakajima & McGowan LLP; Tomoko Nakajima

(57) ABSTRACT

A planing boat including: a hull having a boarding area; a screw unit having a screw, and configured to be rotatable with respect to the hull so that the expulsion direction of a water current by the screw can vary by 360 degrees; and a direction change mechanism having a turning drive force source, and configured to change the expulsion direction by rotating the screw unit with respect to the hull with a drive force of the turning drive force source.

17 Claims, 14 Drawing Sheets

(51) Int. Cl.
*B63H 1/12* (2006.01)
*B63H 25/04* (2006.01)
*B63B 1/04* (2006.01)

(52) U.S. Cl.
CPC ..... *B63B 1/041* (2013.01); *B63H 2001/122* (2013.01)

(56) References Cited

U.S. PATENT DOCUMENTS 4,641,599 A * 2/1987 Thomas ..... B63H 25/42 440/5
7,131,385 B1 * 11/2006 Ehlers ..... B63H 25/48 440/79
10,640,190 B1 * 5/2020 Gonring ..... B63H 21/21
2005/0172882 A1 8/2005 Yung
2007/0089660 A1 * 4/2007 Bradley ..... B63H 21/22 114/144 A
2009/0031941 A1 2/2009 Czarnowski et al.
2011/0275255 A1 * 11/2011 Au ..... B60F 3/0007 440/12.5
2014/0342622 A1 * 11/2014 Davis ..... B63H 23/02 440/53
2015/0028161 A1 * 1/2015 Parks ..... B63H 11/04 244/23 R
2017/0080997 A1 * 3/2017 Zapata ..... B63H 11/113
2019/0283850 A1 * 9/2019 Kooren ..... B63H 5/125
2020/0115012 A1 * 4/2020 Orivuori ..... B63B 39/08
2020/0247516 A1 * 8/2020 Lammers-Meis .... B63H 20/007

FOREIGN PATENT DOCUMENTS

JP 2006-007937 A 1/2006
KR 1816136 B1 * 1/2018 ..... B63B 35/73

* cited by examiner

6：CONTROL UNIT

30：TURNING DRIVE FORCE SOURCE

32：ANGLE DETECTION UNIT

40：PROPULSION DRIVE FORCE SOURCE

50：TILT SENSOR

60：DIRECTION CHANGE CONTROL UNIT

61：PROPULSION SPEED CONTROL UNIT

PLANING BOAT

This application is a national phase entry under 35 U.S.C. § 371 of PCT Patent Application No. PCT/JP2019/000316, filed on Jan. 9, 2019, which claims priority under 35 U.S.C. § 119 to Japanese Patent Application No. 2018-032681, filed Feb. 27, 2018, both of which are incorporated by reference.

TECHNICAL FIELD

The present disclosure relates to a planing boat that expels a water current to travel over water.

BACKGROUND ART

Planing boats (or personal water crafts) such as marine jets, jet skis, and watercrafts use a power source such as an engine to drive a screw, and expel a water current to travel over water.

Patent Literature 1 discloses a planing boat. The planing boat includes: a hull which is boarded by a passenger; an engine disposed inside the hull; a jet propulsion device which drives the screw with the engine and expels a water current; and a steering nozzle serving as a rudder; wherein the steering nozzle swings according to a horizontal swinging of a control board provided in the hull, and the hull is configured to be capable of freely turning.

CITATION LIST

Patent Literature

Patent Literature 1: Japanese Unexamined Patent Application No. 2000-53092

DISCLOSURE OF INVENTION

Problems to be Solved by the Invention

However, in a structure such as that of Patent Literature 1, where a jet propulsion device is fixed to the hull, and the hull is turned as a result of moving the rudder, the steering angle is limited, and sudden direction changes cannot be made to make small-radius turns.

The present disclosure has been made in view of the problems described above, and an object thereof is to provide a planing boat that enables sudden direction changes and is easy to maneuver via small-radius turns.

Means for Solving the Problems

A planing boat of the present disclosure includes: a hull having a boarding area; a screw unit having a screw, and configured to be rotatable with respect to the hull so that the expulsion direction of a water current by the screw can vary by 360 degrees; and a direction change mechanism having a turning drive force source, and configured to change the expulsion direction by rotating the screw unit with respect to the hull with a drive force of the turning drive force source.

According to this configuration, the screw unit is rotatably provided with respect to the hull, the expulsion direction of the water current can vary by 360 degrees, and the expulsion direction of the screw unit is changed by the drive force of the direction change mechanism, and therefore, a planing boat can be provided which is capable of making small-radius turns, and is easy to maneuver. Moreover, because the expulsion direction BD of the water current can be changed with a single screw unit, it is possible to reduce the weight and lower the cost relative to a case where a plurality of screw units is provided.

DESCRIPTION OF EMBODIMENTS

First Embodiment

Hereinafter, a planing boat according to a first embodiment of the present disclosure will be described with reference to the drawings.

Figure 1:
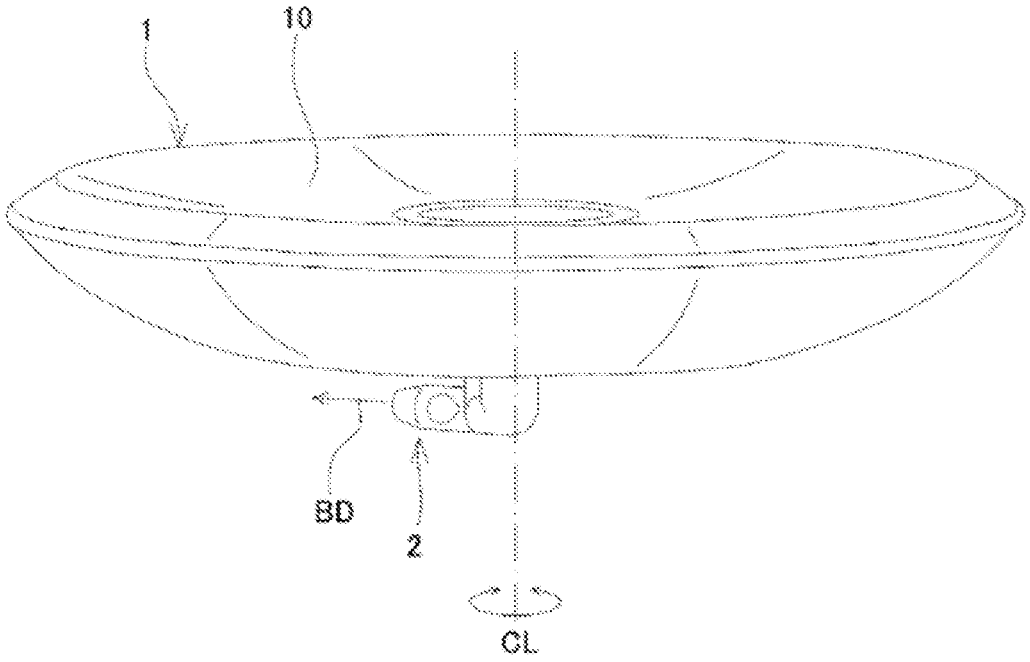
FIG. 1 is a perspective view showing the entire planing boat of a first embodiment.

As shown in FIG. 1, the planing boat of the first embodiment is used to expel a water current to travel over water. The planing boat includes a hull 1 having a boarding area 10, a screw unit 2 capable of expelling a water current, and a direction change mechanism 3 which is configured to change an expulsion direction BD of the water current by the screw unit 2 with a drive force of a turning drive force source 30 (see FIGS. 4 to 7).

Figure 2A:
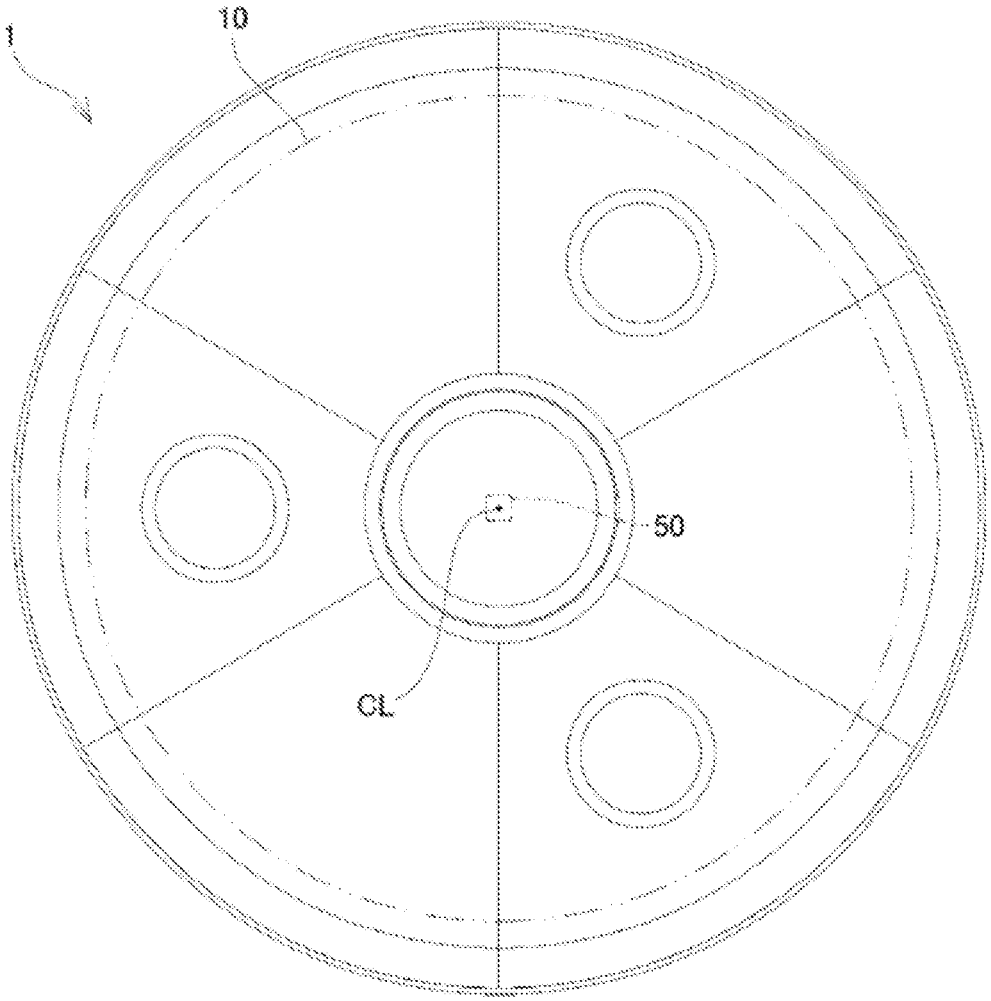
FIG. 2A is a plan view showing the entire planing boat.
Figure 2B:
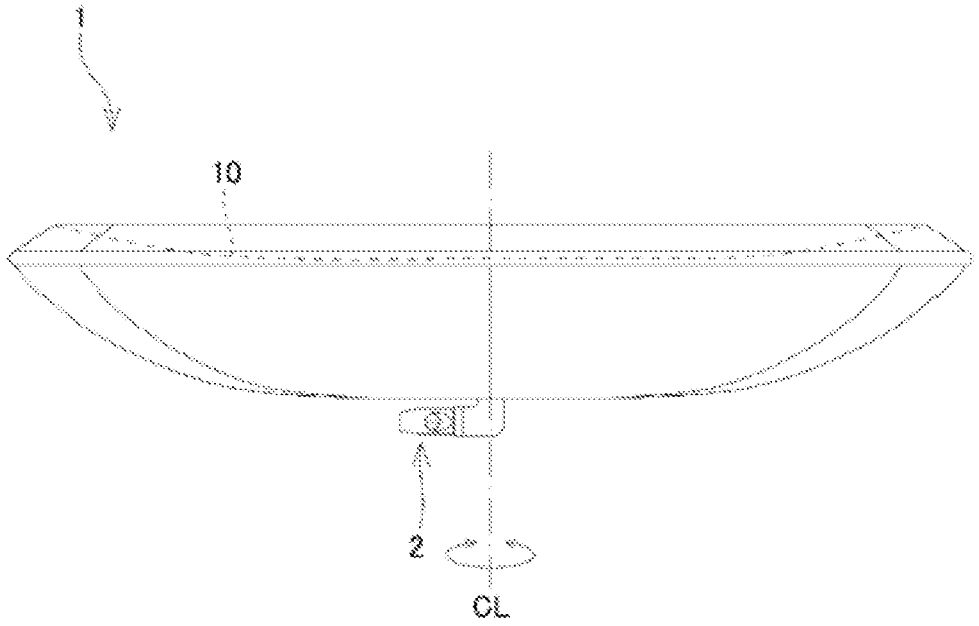
FIG. 2B is a side view showing the entire planing boat.

As shown in FIG. 1, FIG. 2A, FIG. 2B, and FIG. 3, the top of the hull 1 has a boarding area 10 having an area large enough for a person to board. In the first embodiment, as shown in FIG. 2B, the hull 1 has a flat shape overall, and is formed in a shape in which the peripheral part is curved upward from the central part in plan view. As shown in FIGS. 2A and 2B, if the hull 1 is flat and has a circular shape in plan view, the peripheral part can be brought into contact with the ground and rolled when being moved, which enables the portability to be ensured. As shown in FIG. 2A, the hull 1 is formed in a circular shape in plan view, but it is not limited to this. For example, it can be changed to any shape such as a polygonal shape including a square shape, or an oval shape in plan view.

As shown in FIG. 1, the screw unit 2 includes a screw 20 which is rotatable as a result of receiving a drive force (see FIG. 6), and is configured to be rotatable with respect to the hull 1 so that the expulsion direction of the water current by the screw 20 can vary by 360 degrees.

Figure 6:
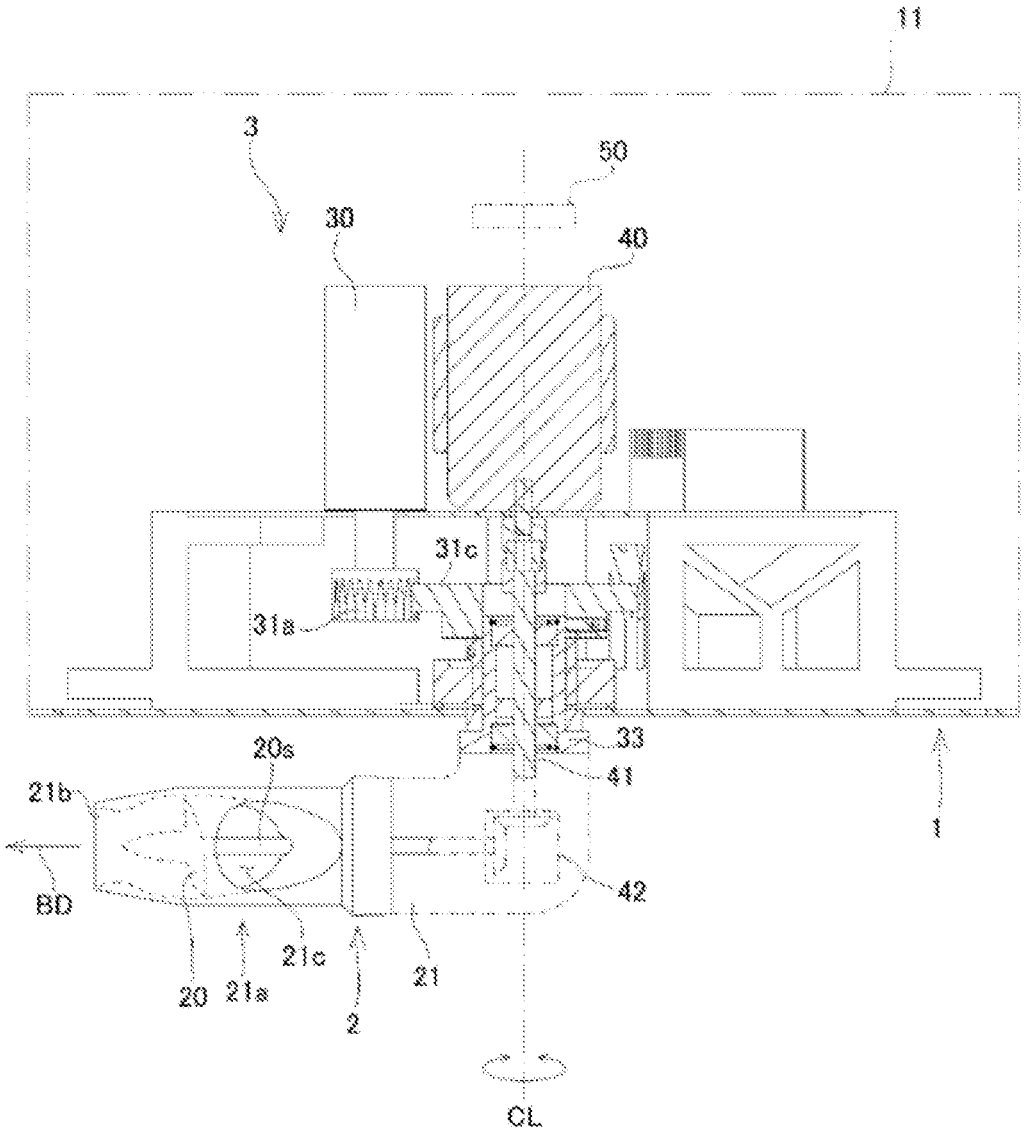
FIG. 6 is a sectional view taken along line A-A in FIG. 5.

Specifically, as shown in FIG. 6, the screw unit 2 includes a screw 20, and a screw case 21 that rotatably supports a screw shaft 20*s* of the screw 20 at the center. The screw case 21 is rotatably attached with respect to the hull 1. In the first embodiment, the screw case 21 includes a rod-shaped portion 21*a*. The screw 20 is housed inside the rod-shaped portion 21*a*, an expulsion port 21*b* that expels a water current by the screw 20 is formed on the distal end of the rod-shaped portion 21*a*, and a water supply port 21*c* is formed in a side wall of the rod-shaped portion 21*a*. Water is taken in from the water supply port 21*c* as a result of the rotation of the screw 20, and a water current is expelled from the expulsion port 21*b* along the axial direction of the rod-shaped portion 21*a*. The water current is expelled from the distal end of the rod-shaped portion 21*a*, and because the proximal end side of the rod-shaped portion 21*a* is rotatably attached with respect to the hull 1, the expulsion direction BD can vary by 360 degrees while always facing the side of the hull 1. Note that, in the first embodiment, the screw unit 2 is attached to the hull 1 such that it is rotatable about an axis CL, which is perpendicular to the expulsion direction BD, but it is not limited to this. The orientation of the screw unit 2 can vary by 360 degrees as long as it is rotatable about an axis which intersects the expulsion direction BD.

Figure 4:
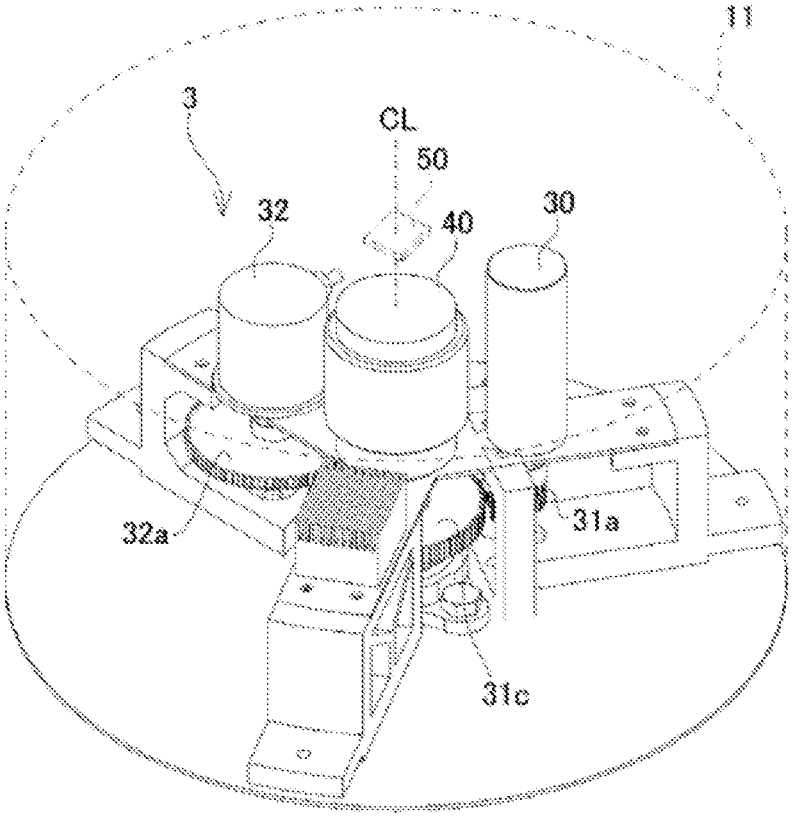
FIG. 4 is a perspective view showing a direction change mechanism inside the first hull unit.

As shown in FIG. 4, FIG. 5, FIG. 6, and FIG. 7, the direction change mechanism 3 includes a turning drive force source 30, and is configured to be capable of rotating the screw unit 2 with respect to the hull 1 based on a drive force of the turning drive force source 30, thereby changing the expulsion direction BD. As shown in FIG. 4 and FIG. 6, the direction change mechanism 3 includes a turning drive force source 30 disposed on the hull 1 side, an input gear 31*c* that can rotate together with the screw unit 2, and an output shaft gear 31*a* attached to an output shaft of the turning drive force source 30 which engages the input gear 31*c* and transmits a drive force to the input gear 31*c*. The rotation shafts of the gears 31*a* and 31*c* are parallel to each other.

Figure 5:
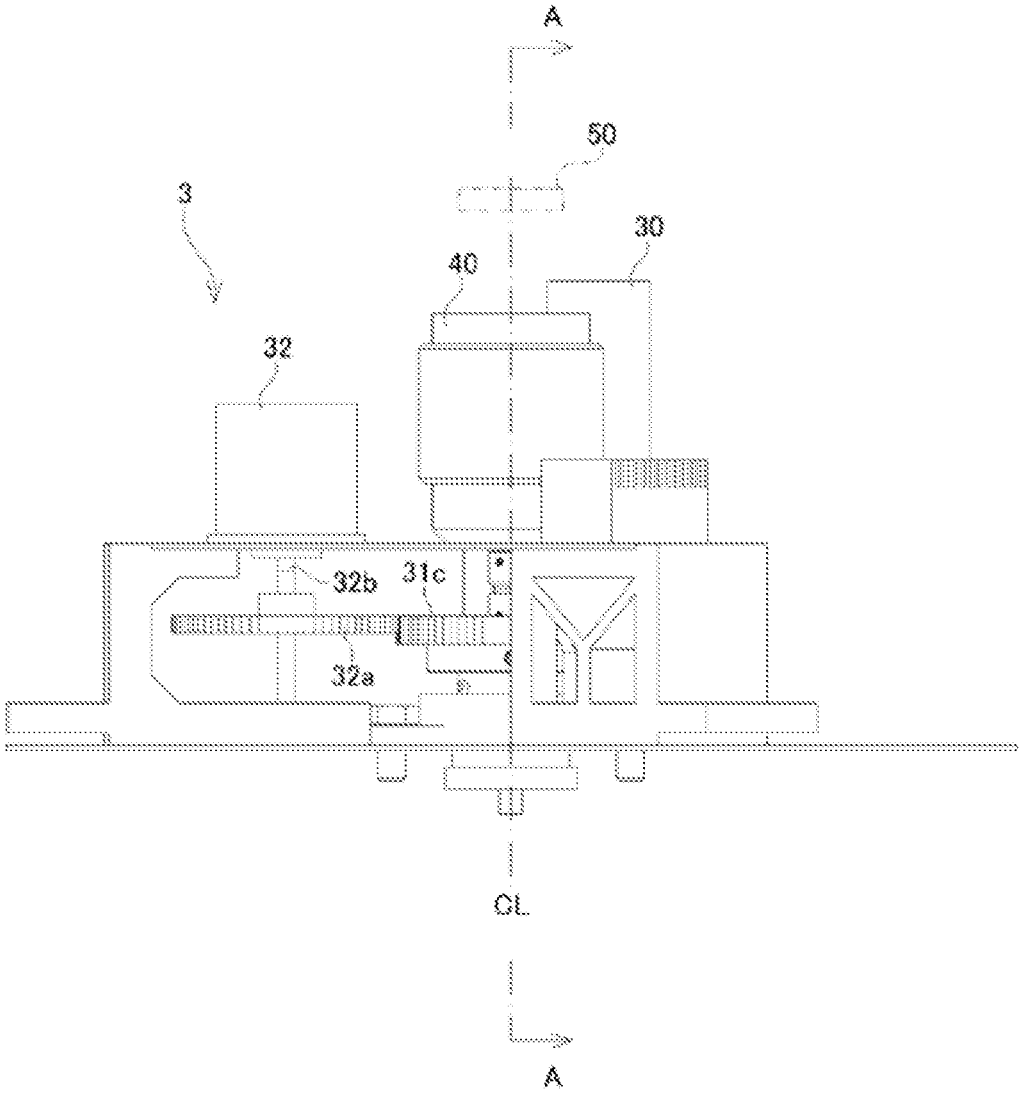
FIG. 5 is a side view showing the direction change mechanism.

As shown in FIG. 4 and FIG. 5, the direction change mechanism 3 has a rotation angle detection unit 32 such as an encoder for detecting the orientation of the screw unit 2. An input shaft 32*b* of the rotation angle detection unit 32 is rotated by a stand gear 32*a*, which engages the input gear 31*c*. The input gear 31*c*, the stand gear 32*a*, and the input shaft 32*b* rotate together with the screw unit 2, and the current orientation of the screw unit 2, that is to say, the expulsion direction BD can be detected as a result of the rotation angle detection unit 32 cumulatively detecting the rotation angle. Note that, in the first embodiment, the turning drive force source 30 is implemented as a motor, but it is not limited to this. For example, the output of an engine may be used as the turning drive force source 30.

As shown in FIG. 4, FIG. 5, and FIG. 6, the planing boat includes a propulsion drive force source 40 such as a motor for driving the screw 20. In the first embodiment, although the propulsion drive force source 40 is disposed inside the hull 1, it is not limited to this, and the propulsion drive force source 40 may be provided in the screw unit 2. In the first embodiment, the propulsion drive force source 40 is disposed inside the hull 1, and a drive force transmission shaft 41 that transmits the drive force from the propulsion drive force source 40 to the screw unit 2 is disposed along the rotational axis CL of the screw unit 2 with respect to the hull 1. The drive force transmission shaft 41 and the screw shaft 20*s* of the screw 20 are connected via a drive force transmission direction change mechanism 42 such as a bevel gear. The propulsion drive force source 40 is disposed on a line extending from the drive force transmission shaft 41, the output shaft of the propulsion drive force source 40 and the drive force transmission shaft 41 lie on the same axis, and the drive force of the propulsion drive force source 40 is directly input to the drive force transmission shaft 41 via a coupling. As a result, losses in the drive force can be suppressed. Of course, in a configuration where the propulsion drive force source 40 is not disposed on a line extending from the drive force transmission shaft 41, a drive force transmission direction change mechanism such as a bevel gear may be provided separately. By doing so, the height of the device can be reduced.

As shown in FIG. 6, the turning transmission shaft 33, which connects the screw unit 2 and the input gear 31*c*, lies on the same axis as the drive force transmission shaft 41, and is disposed on the outside of the drive force transmission shaft 41. That is to say, a two-layered shaft is provided in which the outside shaft 33 is used for turning, and the inside shaft 41 is used for propulsion. Note that, in the first embodiment, the propulsion drive force source 40 is implemented as a motor, but it is not limited to this. For example, the output of an engine may be used as the propulsion drive force source 40.

As shown in FIG. 2A, FIG. 4, FIG. 5, and FIG. 6, the inside of the hull 1 is provided with a tilt sensor 50 which detects the tilt of the hull 1 with respect to the horizontal direction. The tilt sensor 50 is a gyro sensor and is capable of detecting the tilt direction and the angle with respect to the horizontal direction. In the first embodiment, as shown in FIG. 2A, the shape of the hull 1 is circular in plan view, and the tilt sensor 50 is disposed at the center CL of the circle. According to this configuration, because the detection result of the tilt sensor 50 directly corresponds to the tilt direction of the hull 1, it is possible to obtain the true tilt direction and tilt angle of the hull 1 without implementing a correction process. This is because a deviation of the tilt sensor 50 from the center CL of the hull 1 necessitates a correction that corresponds to the deviation. In the first embodiment, although the center CL of the hull 1 in plan view coincides with the rotational axis of the screw unit 2 with respect to the hull 1, the two do not have to coincide.

Figure 7:
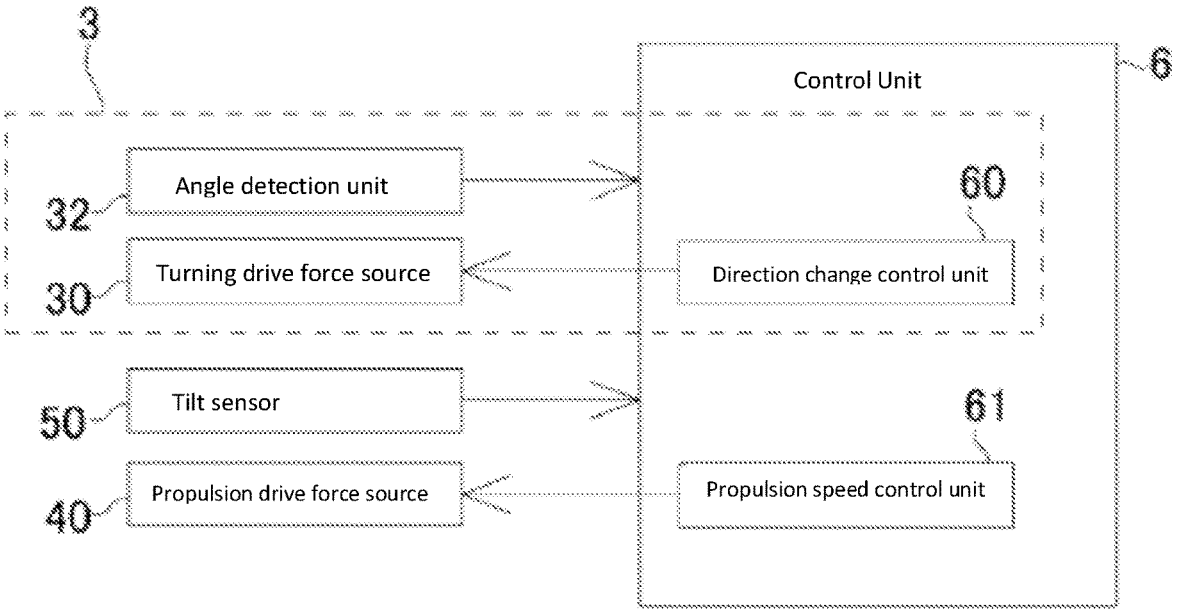
FIG. 7 is a block diagram relating to a control unit of the planing boat.
Figure 8A:
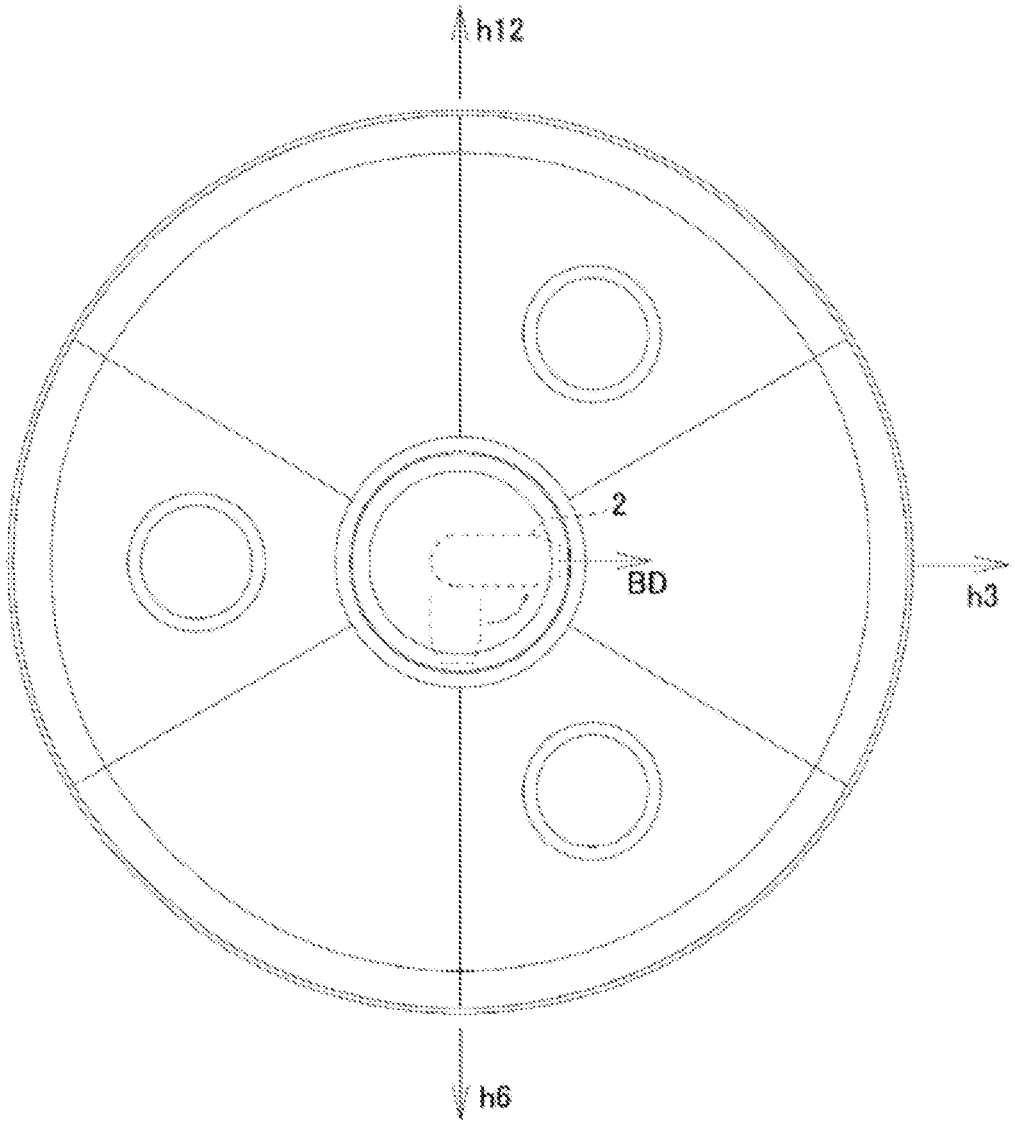
FIG. 8A is a plan view relating to an operation when the hull is tilted with respect to the water surface.
Figure 8B:
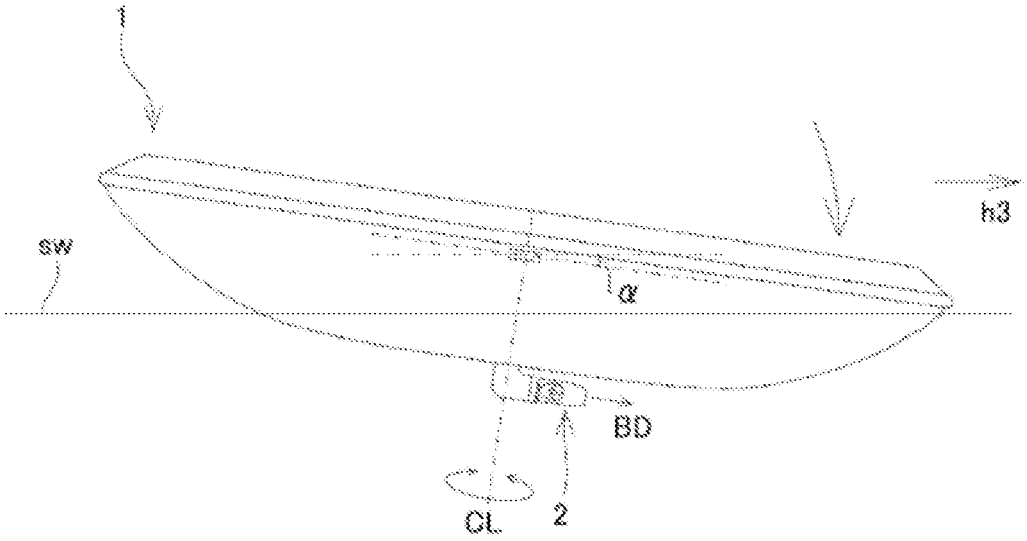
FIG. 8B is a side view relating to an operation when the hull is tilted with respect to the water surface.

The planing boat has a control unit 6 shown in FIG. 7. The control unit 6 is configured to receive the detection signal of the rotation angle detection unit 32 and the detection signal of the tilt sensor 50, and control the propulsion drive force source 40 and the turning drive force source 30. The control unit 6 has a direction change control unit 60. The direction change control unit 60 is configured to control the turning drive force source 30 according to the tilt direction of the hull detected by the tilt sensor 50, and change the expulsion direction BD. For example, a control may be performed so that a downwardly tilted direction of the hull 1 in plan view matches the expulsion direction BD. FIG. 8A and FIG. 8B are a plan view and a side view relating to an operation when the hull 1 is tilted with respect to the water surface sw. Specifically, as shown in FIG. 8A and FIG. 8B, when a certain direction in plan view is a twelve o'clock direction h12, the expulsion direction before the change is a six o'clock direction h6, and the direction in which the hull 1 is downwardly tilted is a three o'clock direction h3, the control unit 6 controls the driving of the turning drive force source 30 so that the expulsion direction BD faces the three o'clock direction h3. Specifically, the tilt sensor 50 detects that the hull 1 is tilted in the three o'clock direction h3, calculates the angle to be detected by the rotation angle detection unit 32 in order to change the orientation of the screw unit 2 from the current orientation (six o'clock direction h6) to the three o'clock direction h3, causes the turning drive force source 30 to rotate the screw unit 2, and stops the driving of the turning drive force source 30 so that the angle detected at the rotation angle detection unit 32 becomes the calculated angle mentioned above. As a result, as shown in FIG. 8A and FIG. 8B, the hull 1 is propelled forward with the direction in which the hull 1 is downwardly tilted being the rear. Of course, the hull may be set to propel forward with the direction in which the hull 1 is downwardly tilted being the front.

As shown in FIG. 7, the control unit 6 has a propulsion speed control unit 61. As shown in FIG. 8A and FIG. 8B, the propulsion speed control unit 61 is configured to change the propulsion force of the screw 20 according to the tilt angle α with respect to the horizontal direction detected by the tilt sensor 50. When the tilt of the hull 1 is small, the rotation speed of the propulsion drive force source 40 is low, the rotation speed of the screw 20 is low, and the propulsion force is small. When the tilt of the hull 1 becomes large, the rotation speed of the propulsion drive force source 40 increases, the rotation speed of the screw 20 is high, and the propulsion force is large. Note that the screw 20 may be configured to always rotate at a constant speed regardless of the tilt angle. Furthermore, although the propulsion force is changed by changing the rotation speed of a single screw 20, a configuration is also possible where a plurality of screws is provided and the propulsion force is changed by changing the number of screws that are driven.

When use is intended in the presence of waves, the waves may cause the hull 1 to sway in small increments, and the orientation of the screw unit 2 may unintentionally change. Therefore, when the tilt direction of the hull 1 detected by the tilt sensor 50 is maintained for a predetermined time, the expulsion direction BD of the screw unit 2 may be changed according to the detected tilt direction of the hull 1. Further, in addition to the tilt direction of the hull 1, it is useful to add the condition that the tilt angle is maintained at a predetermined angle or more for a predetermined period.

In a configuration in which the direction change control of the screw unit 2 and the drive control of the screw 20 are independent, if the orientation of the hull is suddenly and significantly changed when the hull is stopped or is being propelled at a low speed substantially equivalent to being stopped, the hull 1 may proceed in an unexpected direction due to rotation of the screw 20 while the orientation of the screw unit 2 is being changed. The following implementation is preferable for preventing such an unintended operation. If a change in the tilt of the hull 1 is detected by the tilt sensor 50 when the screw 20 is stopped or the rotation speed of the screw 20 is a predetermined value or less, the expulsion direction BD of the screw unit 2 is changed to an orientation corresponding to the detected tilt direction of the hull 1, and expulsion of the water current by the screw 20 is started after the change in the expulsion direction BD is completed. According to this configuration, it is possible to prevent the hull from proceeding in an unexpected direction.

When the rotation speed of the screw 20 is greater than the predetermined value, changing of the orientation of the screw unit 2 and the driving of the screw 20 are performed simultaneously. According to this configuration, it is possible for the hull 1 to be turned while being propelled.

Figure 3:
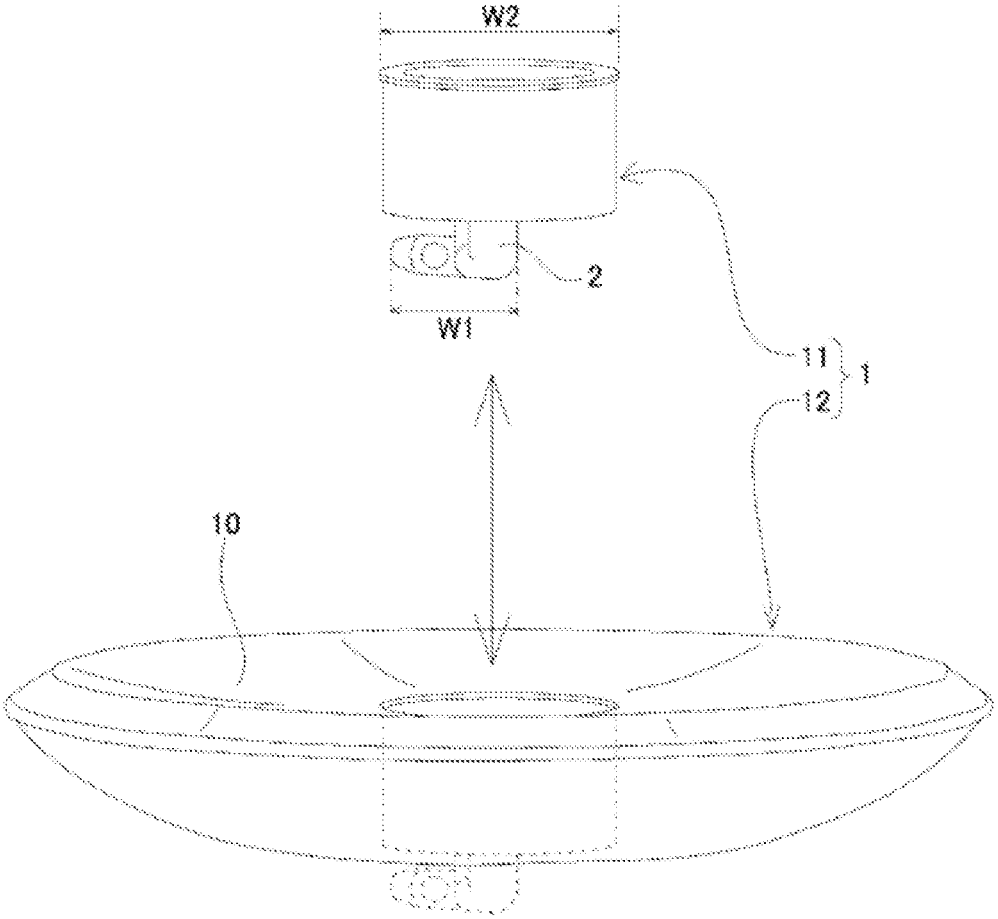
FIG. 3 is a perspective view showing a first hull unit and a second hull unit that constitute a hull.

As shown in FIG. 3, the hull 1 includes a first hull unit 11 that rotatably supports the screw unit 2, and a second hull unit 12 which excludes the first hull unit 11. As shown in the same diagram, the screw unit 2 and the first hull unit 11 are integrated and are configured to be detachable with respect to the second hull unit 12. As shown in FIG. 4, the propulsion drive force source 40 for driving the turning drive force source 30 and the screw 20 are disposed in the first hull unit 11. In addition, the control unit 6, the tilt sensor 50, and the direction change mechanism 3 are disposed in the first hull unit 11. In the first embodiment, a battery is disposed in the second hull unit 12, but it may also be disposed in the first hull unit 11.

As shown in FIG. 3, the maximum dimension W1 of the screw unit 2 in plan view is smaller than the maximum dimension W2 of the first hull unit 11 in plan view. The screw unit 2 entirely overlaps the first hull unit 11 in plan view. As a result, the screw unit 2 and the first hull unit 11 can be pulled out from the second hull unit 12 in an upward direction. Note that the hull 1 can be integrally configured without being separated into the first hull unit 11 and the second hull unit 12.

As described above, the planing boat of the first embodiment includes: a hull 1 having a boarding area 10; a screw unit 2 having a screw 20, and configured to be rotatable with respect to the hull 1 so that the expulsion direction BD of a water current by the screw 20 can vary by 360 degrees; and a direction change mechanism 3 having a turning drive force source 30, and configured to be capable of rotating the screw unit 2 with respect to the hull 1 with a drive force of the turning drive force source 30, and changing the expulsion direction BD.

According to this configuration, the screw unit 2 is rotatably provided with respect to the hull 1, the expulsion direction BD of the water current can vary by 360 degrees, and the expulsion direction BD of the screw unit 2 is changed by the drive force of the direction change mechanism 3, and therefore, a planing boat can be provided which is capable of making small-radius turns, and is easy to maneuver. Moreover, because the expulsion direction BD of the water current can be changed with a single screw unit 2, it is possible to reduce the weight and lower the cost relative to a case where a plurality of screw units 2 is provided.

In the first embodiment, a tilt sensor 50 is provided that detects the tilt of the hull 1 with respect to the horizontal direction, and the expulsion direction BD is changed according to the tilt direction of the hull 1 detected by the tilt sensor 50.

According to this configuration, a change in the tilt direction of the hull 1 caused by a weight shift can change the expulsion direction BD of the screw unit 2, that is to say, the propulsion direction of the hull 1, and therefore, it is not necessary to provide an operation means for changing the direction, and it is possible to reduce the time required from boarding until achieving a posture in which operations are possible, which enables user convenience to be improved.

The first embodiment is configured to change the propulsion force by the screw 20 according to the tilt angle α with respect to the horizontal direction detected by the tilt sensor 50.

According to this configuration, it is not necessary to provide an operation means for changing the propulsion force, and it is possible to reduce the time required from boarding until achieving a posture in which operations are possible, which enables user convenience to be improved.

In the first embodiment, a propulsion drive force source 40 for driving the screw 20 is provided, and the propulsion drive force source 40 is disposed inside the hull 1.

According to this configuration, the weight of the screw unit 2 can be reduced and the turning drive force required by the direction change mechanism 3 can be made smaller compared to a configuration where the propulsion drive force source 40 is provided in a screw unit 2 which is rotatable with respect to the hull 1. Furthermore, because the weight of the screw unit 2 can be reduced, the rotation speed of the screw unit 2 can be increased, and the turning speed can also be improved.

In the first embodiment, a drive force transmission shaft 41 is provided which is disposed along the rotational axis CL of the screw unit 2 with respect to the hull 1, and which transmits a drive force from the propulsion drive force source 40 to the screw unit 2, and the propulsion drive force source 40 is disposed on a line extending from the drive force transmission shaft 41.

According to this configuration, the drive force of the propulsion drive force source 40 disposed in the hull 1 can be directly input to the drive force transmission shaft 41, and, for example, the drive force transmission direction change mechanism such as a bevel gear or a worm gear which becomes necessary in a configuration where the propulsion drive force source 40 is not disposed on a line extending from the drive force transmission shaft 41 can be omitted, and it becomes possible to reduce costs and losses in the drive force.

In the first embodiment, the hull 1 includes a first hull unit 11 that rotatably supports the screw unit 2, and a second hull unit 12 which excludes the first hull unit 11, and the screw unit 2 and the first hull unit 11 are integrally configured to be detachable from the second hull unit 12.

According to this configuration, when a problem occurs in the screw unit 2 or the first hull unit 11, these can be detached from the second hull unit 12, and the maintainability improves because it is no longer necessary to carry the entire planing boat when exchanging components.

Alternatively, although the screw unit 2 may come into contact with the ground when being lifted from the water onto land, if the screw unit 2 and the first hull unit 11 are detached from the second hull unit 12 in the water, it is possible to reduce the concern of a malfunction caused by unintended contact between the screw unit 2 and the ground.

In the first embodiment, the propulsion drive force source 40 for driving the turning drive force source 30 and the screw 20 are disposed in the first hull unit 11.

According to this configuration, because the turning drive force source 30 and the propulsion drive force source 40 are disposed in the first hull unit 11, if the first hull unit 11 is detached from the second hull unit 12, the maintainability improves because it is no longer necessary to carry the entire planing boat when exchanging components. It is preferable for all electric components other than the battery to be disposed inside the first hull unit 11.

In the first embodiment, the screw unit 2 entirely overlaps the first hull unit 11 in plan view.

According to this configuration, because the screw unit 2 does not laterally protrude from the first hull unit 11, the first hull unit 11 can be pulled out from the second hull unit 12 in an upward direction without causing interference between the screw unit 2 and the second hull unit 12, which eliminates the need to turn over the hull 1 and enables the maintainability to be improved.

In the first embodiment, the tilt sensor 50 is disposed at the center CL of the hull 1 in plan view.

According to this configuration, the tilt angle $\alpha$ of the hull 1 can be easily and accurately grasped with respect to any direction, which reduces control implementation costs.

In the first embodiment, when the tilt direction of the hull 1 detected by the tilt sensor 50 is maintained for a predetermined time, the expulsion direction BD of the screw unit 2 is changed according to the detected tilt direction of the hull 1.

According to this configuration, because the expulsion direction BD of the screw unit 2 is changed when a passenger intentionally maintains the tilt angle of the hull 1 for a predetermined time, it is possible to prevent unintentional changes in the expulsion direction BD of the screw unit 2 and unintentional changes in the travel direction from occurring in environments where the hull sways in small increments and the tilt direction of the hull 1 changes in small increments.

In the first embodiment, if a change in the tilt of the hull 1 is detected by the tilt sensor 50 when the screw 20 is stopped or the rotation speed of the screw 20 is a predetermined value or less, the expulsion direction BD of the screw unit 2 is changed to an orientation corresponding to the detected tilt direction of the hull 1, and expulsion of the water current by the screw 20 is started after the change in the expulsion direction BD is completed.

According to this configuration, the driving of the screw 20 starts after the expulsion direction BD of the screw unit 2 is changed, and therefore, it is possible to prevent the hull 1 from proceeding in an unexpected direction.

Although the first embodiment of the present disclosure has been described above with reference to the drawings, the specific configuration should not be considered to be limited to this embodiment. The scope of the present disclosure is defined not only by the description of the above embodiment but by the scope of the claims, and further, all modifications that fall within a meaning and scope equivalent to the scope of the claims are included.

For example, in the first embodiment, a tilt sensor 50 is provided for changing the expulsion direction BD, but it is not limited to this. For example, it is also possible for an operation means such as a lever to be provided.

In the first embodiment, the tilt angle $\alpha$ detected by the tilt sensor 50 is used to change the propulsion force (propulsion speed), but it is not limited to this. For example, it is also possible for an operation means such as a lever to be provided.

In the first embodiment, the propulsion drive force source 40 is disposed in the hull 1 rather than the screw unit 2, but it is not limited to this. If the propulsion drive force source 40 is disposed in the screw unit 2, it is possible to adopt a configuration in which the propulsion drive force source 40 is cooled by the surrounding water. Furthermore, when compared with the configuration of the first embodiment, drive force transmission losses can be reduced because the distance between the propulsion drive force source 40 and the screw 20 becomes shorter.

Second Embodiment

Hereinafter, a planing boat according to a second embodiment of the present disclosure will be described with reference to the drawings. The planing boat of the first embodiment is configured such that the expulsion direction BD of the screw unit 2 is changed using the drive force of a drive force source such as a motor. In contrast, the planing boat of the second embodiment is configured to change the expulsion direction BD of the screw unit 202 by the weight of the screw unit 202 itself, without using a drive force.

Figure 9:
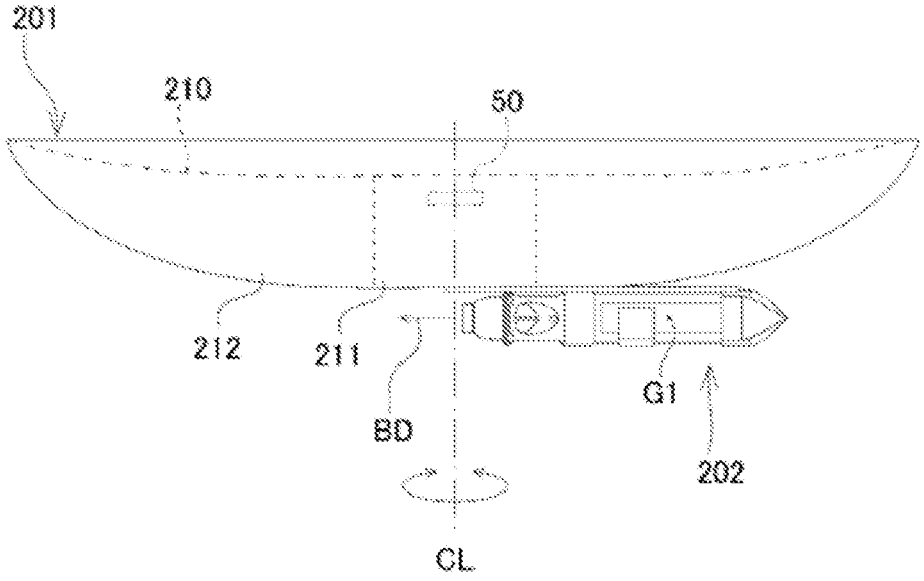
FIG. 9 is a side view showing the entire planing boat of a second embodiment.
Figure 10A:
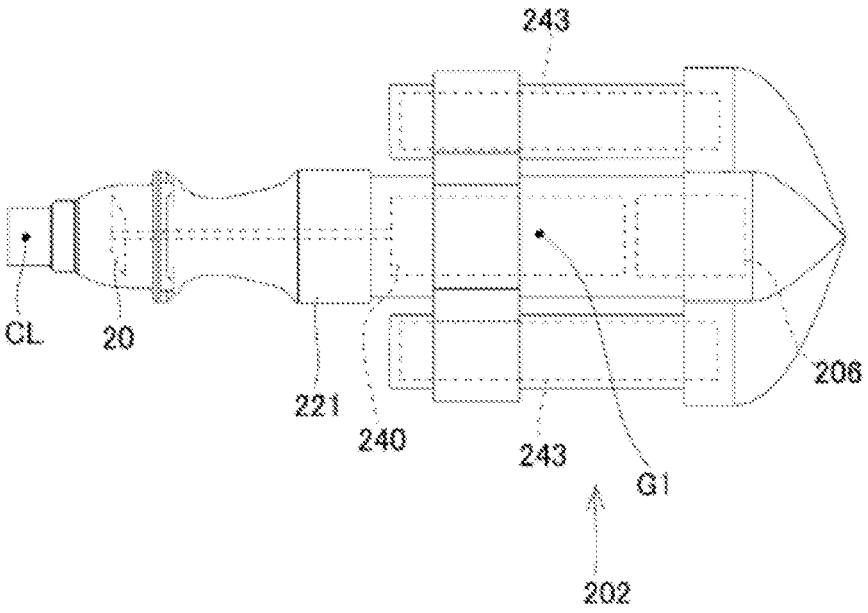
FIG. 10A is a bottom view and FIG. 10B is a side view showing a screw unit of the second embodiment.
Figure 10B:
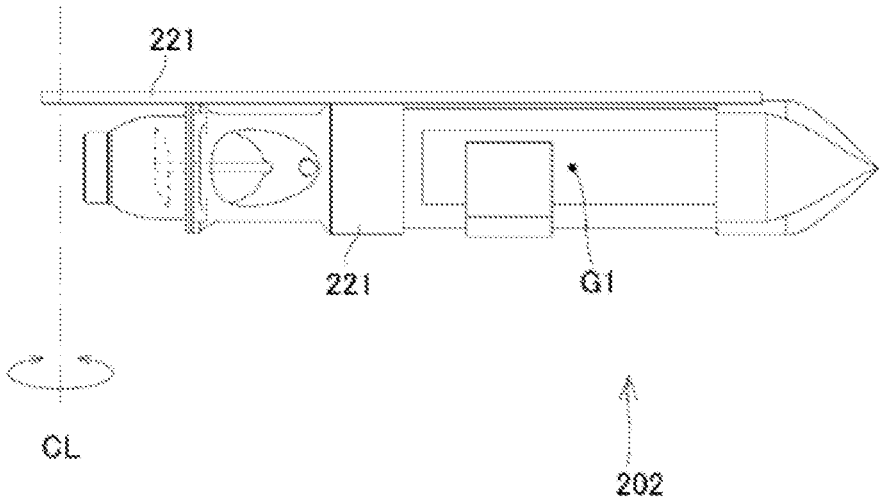

As shown in FIG. 9 and FIGS. 10A and 10B, the planing boat of the second embodiment includes: a hull 201 having a boarding area 210; and a screw unit 202 having a screw 20, and configured to be rotatable with respect to the hull 201 so that the expulsion direction of a water current by the screw 20 can vary by 360 degrees.

Like the first embodiment, the hull 201 of the second embodiment is divided into a first hull unit 211 and a second hull unit 212, and the first hull unit 211 is configured to be detachable from the second hull unit 212. Of course, the hull 201 does not have to be divided into a plurality of units. The hull 201 is provided with a tilt sensor 50 using a gyro sensor. The tilt sensor 50 is preferably disposed at the center of the hull 201.

The screw unit 202 includes a screw 20 and a screw case 221. The screw case 221 is attached to the hull 201 so as to be rotatable about the rotational axis CL. In the second embodiment, the screw case 221 includes a motor 240 for driving the screw 20, a motor control unit 206 for controlling the motor 240, and a battery 243 that supplies electric power to the motor 240 and the motor control unit 206. The motor control unit 206 is capable of receiving a signal from the tilt sensor 50 via a wireless communication module (not shown). Like the first embodiment, the motor control unit 206 is configured to change the propulsion force of the screw 20 according to the tilt angle with respect to the horizontal direction detected by the tilt sensor 50. Of course, as mentioned in the first embodiment, the propulsion force (rotation speed of the screw 20) may be constant.

Figure 11:
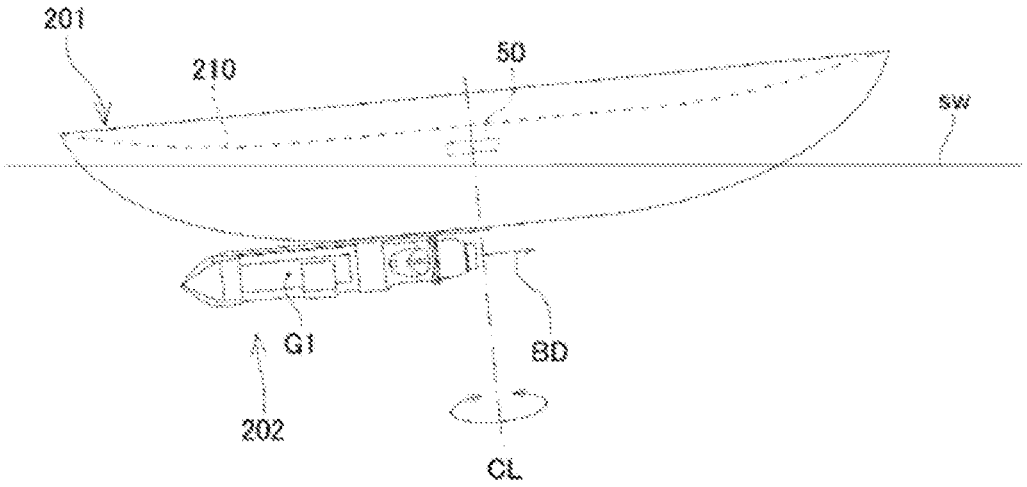
FIG. 11 is a side view relating to an operation when the hull is tilted with respect to the water surface in the second embodiment.

As shown in FIG. 9 and FIGS. 10A and 10B, the center of gravity position G1 of the screw unit 202 is disposed at a position eccentric from a support axis CL of the hull 201. Consequently, as shown in FIG. 11, the expulsion direction BD is changed according to the tilt direction of the hull 201 by the own weight of the screw unit 202. In the example shown in FIG. 11, the hull 201 may be set to propel forward with the direction in which the hull 201 is downwardly tilted being the front, but it is not limited to this. For example, if the orientation in which the screw unit 202 is installed is reversed, the hull 201 may be configured to propel forward with the direction in which the hull 201 is downwardly tilted being the rear.

The configuration described in the first embodiment and the control of the motor 240 can be arbitrarily employed with respect to the planing boat of the second embodiment as long as no contradiction occurs.

Third Embodiment

Figure 12:
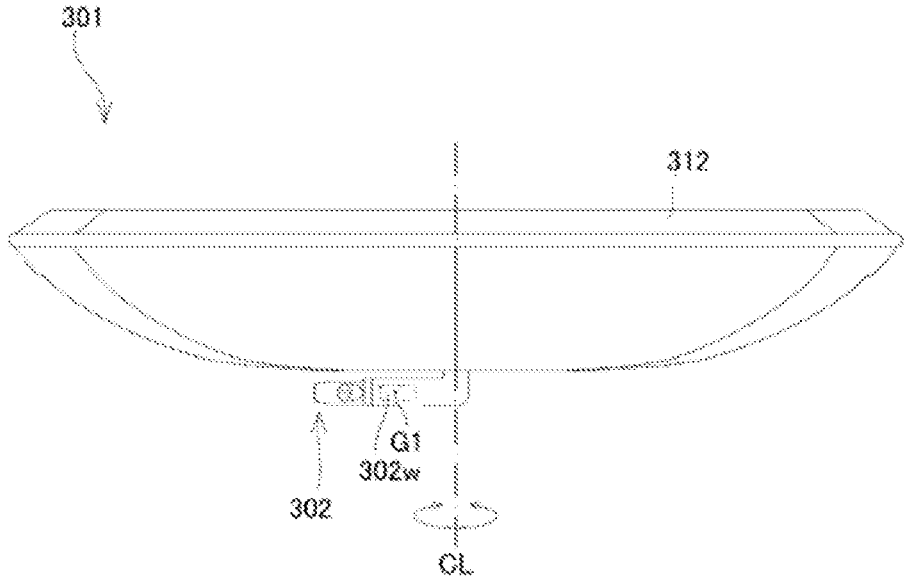
FIG. 12 is a side view showing a planing boat of a third embodiment and a schematic partial sectional view corresponding to FIG. 6.
Figure 12:
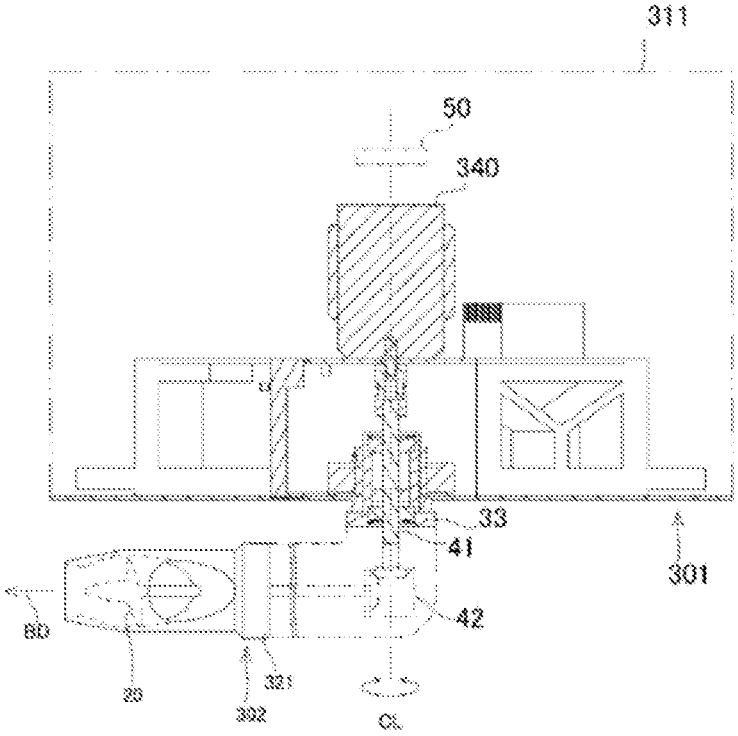

Hereinafter, a planing boat according to a third embodiment of the present disclosure will be described with reference to the drawings. As shown in FIG. 12, like the second embodiment, the planing boat of the third embodiment is configured to change the expulsion direction BD of the screw unit 302 by the weight of the screw unit 302 itself, without using a drive force. In the third embodiment, a propulsion drive force source 340 for driving the screw 20 is disposed inside the hull 301. Like the first embodiment, the hull 301 of the third embodiment is divided into a first hull unit 311 and a second hull unit 312 which are configured to be detachable from each other. Of course, the hull 301 does not have to have a divided structure.

In the third embodiment, the direction change mechanism 3 of the first embodiment has been removed. The screw unit 302 is a two-layered shaft which is rotatably supported by the hull 301, and the inside shaft 41 is configured so as to transmit the drive force from the propulsion drive force source 340 disposed in the hull 301, however the outside shaft 33 is not connected to a drive force source and is allowed to rotate according to the weight of the screw unit 302 itself. As described above, the center of gravity position G1 of the screw unit 302 is disposed at a position eccentric from the support axis CL of the hull 301, and the expulsion direction BD of the screw unit 302 is changed by the weight of the screw unit 302 itself according to the tilt direction of the hull 301.

In order to facilitate the operation of turning by the own weight of the screw unit 302, it is preferable to provide the screw unit 302 with a counterweight 302*w* for ensuring the own weight.

In the third embodiment, although the propulsion drive force source 340 is a motor, an engine may also be used.

The configuration described in the first embodiment and the control of the propulsion drive force source 340 can be arbitrarily employed with respect to the planing boat of the third embodiment as long as no contradiction occurs.

As described above, the planing boat of the second embodiment and the third embodiment includes a hull 201 or 301 having a boarding area, and a screw unit 202 or 302 having a screw 20 and being configured to be rotatable with respect to the hull 201 or 301 so that the expulsion direction of a water current by the screw 20 can vary by 360 degrees. The center of gravity position G1 of the screw unit 202 or 302 is disposed at a position eccentric from the support axis CL of the hull 201 or 301, and the expulsion direction BD is changed by the own weight of the screw unit 202 or 302 according to the tilt direction of the hull 201 or 301.

According to this configuration, the screw unit 202 or 302 is rotatably provided with respect to the hull 201 or 301, the expulsion direction BD of the water current can vary by 360 degrees, and the expulsion direction BD of the screw unit 202 or 302 is changed by the weight of the screw unit 202 or 302 itself, and therefore, a planing boat can be provided which is capable of making small-radius turns, and is easy to maneuver. Moreover, because the expulsion direction BD of the water current can be changed with a single screw unit 202 or 302, it is possible to reduce the weight and lower the cost relative to a case where a plurality of screw units is provided.

In the second embodiment and the third embodiment, a tilt sensor 50 that detects the tilt of the hull 201 or 301 with respect to the horizontal direction is provided, and the propulsion force from the screw 20 is changed according to the tilt angle with respect to the horizontal direction detected by the tilt sensor 50.

According to this configuration, it is not necessary to provide an operation means for changing the propulsion force, and it is possible to reduce the time required from boarding until achieving a posture in which operations are possible, which enables user convenience to be improved.

In the second embodiment and the third embodiment, the tilt sensor 50 is disposed at the center CL of the hull 201 or 301 in plan view.

According to this configuration, the tilt angle $\alpha$ of the hull 1 can be easily and accurately grasped with respect to any direction, which reduces control implementation costs.

In the second embodiment, the screw unit 202 includes a motor 240 for driving the screw 20, a motor control unit 206 for controlling the motor 240, and a battery 243 that supplies electric power to the motor 240 and the motor control unit 206.

According to this configuration, the motor 240, the motor control unit 206, and the battery 243 are integrated in the screw unit 202, and therefore, the screw unit 202 can be exchanged when a problem occurs, and the maintainability can be improved because it is not necessary to transport the entire hull 201.

In the third embodiment, a propulsion drive force source 340 for driving the screw 20 is provided, and the propulsion drive force source 340 is disposed inside the hull 301.

According to this configuration, because a large propulsion drive force source 340 can be disposed compared to a configuration where the propulsion drive force source is disposed in the screw unit 302, the propulsion power can be ensured. An engine can also be employed. Furthermore, when the propulsion drive force source 340 is a motor, the quantity of installed batteries 243 can be increased compared to a configuration in which the propulsion drive force source is disposed in the screw unit 302.

In the third embodiment, a drive force transmission shaft 41 is provided which is disposed along the rotational axis CL of the screw unit 302 with respect to the hull 301, and which transmits a drive force from the propulsion drive force source 340 to the screw unit 302, and the propulsion drive force source 340 is disposed on a line extending from the drive force transmission shaft 41.

According to this configuration, the drive force of the propulsion drive force source 340 disposed in the hull 301 can be directly input to the drive force transmission shaft 41, and, for example, the drive force transmission direction change mechanism such as a bevel gear or a worm gear which becomes necessary in a configuration where the propulsion drive force source 340 is not disposed on a line extending from the drive force transmission shaft 41 can be omitted, and it becomes possible to reduce costs and losses in the drive force.

In the second embodiment and the third embodiment, the hull 201 or 301 includes a first hull unit 211 or 311 that supports the screw unit 202 or 302, and a second hull unit 212 or 312 which excludes the first hull unit 211 or 311, and the screw unit 202 or 302 and the first hull unit 211 or 311 are integrally configured to be detachable from the second hull unit 212 or 312.

According to this configuration, when a problem occurs in the screw unit 202 or 302 or the first hull unit 211 or 311, these can be detached from the second hull unit 212 or 312, and the maintainability improves because it is no longer necessary to carry the entire planing boat when exchanging components. Alternatively, although the screw unit 202 or 302 may come into contact with the ground when being lifted from the water onto land, if the screw unit 202 or 302 and the first hull unit 211 or 311 are detached from the second hull unit 212 or 312 in the water, it is possible to reduce the concern of a malfunction caused by unintended contact between the screw unit 202 or 302 and the ground.

Specifically, in the third embodiment shown in FIG. 12, when the screw unit 302 is smaller than the first hull unit 311 and the entire screw unit 302 overlaps with the first hull unit 311 in plan view, the screw unit 302 and the first hull unit 311 can be inserted or detached from the second hull unit 312 from above the hull, and the maintainability can be improved because it is not necessary to turn over the hull. In the second embodiment shown in FIG. 9, FIGS. 10A and 10B, and FIG. 11, because the screw unit 202 is larger than the first hull unit 211, it cannot be detached from above the hull, but it can be detached from below the hull. Of course, if the screw unit 202 of the second embodiment is made smaller than the first hull unit 211, it can be detached from above the hull.

Although the second embodiment and the third embodiment of the present disclosure have been described above with reference to the drawings, specific configurations should not be considered to be limited to these embodiments. The scope of the present disclosure is defined not only by the description of the above embodiments but by the scope of the claims, and further, all modifications that fall within a meaning and scope equivalent to the scope of the claims are included.

DESCRIPTION OF REFERENCE NUMERALS

1 Hull
10 Boarding area
11 First hull unit
12 Second hull unit
2 Screw unit
20 Screw
3 Direction change mechanism
30 Turning drive force source
40 Propulsion drive force source
41 Drive force transmission shaft
50 Tilt sensor
BD Expulsion direction

The invention claimed is:

1. A planing boat comprising:
a hull having a boarding area;
a screw unit having a screw provided at the hull, and
configured to change an expulsion direction of a water current
a tilt sensor that detects a tilt of the hull with respect to a horizontal direction, wherein an expulsion direction of the screw unit is matched in parallel with a tilt direction of the hull detected by the tilt sensor.

2. A planing boat comprising:
a hull having a boarding area;
a screw unit having a screw provided at the hull, and configured to change an expulsion direction of a water current
a tilt sensor that detects a tilt of the hull with respect to a horizontal direction, wherein an expulsion direction of the screw unit is changed according to a tilt direction of the hull detected by the tilt sensor,
wherein the hull is formed in a circular shape in a plan view, and the tilt sensor is a gyro sensor and provided in a center of the circular shape.

3. The planing boat according to claim 2, wherein
a propulsion force by the screw is changed according to a tilt angle with respect to a horizontal direction detected by the tilt sensor.

4. The planing boat according to claim 1, comprising
a propulsion drive force source for driving the screw, wherein
the propulsion drive force source is disposed inside the hull.

5. The planing boat according to claim 4, comprising
a drive force transmission shaft disposed along a rotational axis of the screw unit with respect to the hull, which transmits a drive force from the propulsion drive force source to the screw unit, wherein
the propulsion drive force source is disposed on a line extending from the drive force transmission shaft.

6. The planing boat according to claim 1, wherein
the hull includes a first hull unit that rotatably supports the screw unit and a second hull unit which excludes the first hull unit, and
the screw unit and the first hull unit are integrated, and are configured to be detachable from the second hull unit.

7. The planing boat according to claim 6, wherein
a propulsion drive force source, for driving the turning drive force source and the screw, is disposed in the first hull unit.

8. The planing boat according to claim 1, wherein if a change in the tilt of the hull is detected by the tilt sensor when the screw is stopped or a rotation speed of the screw is a predetermined value or less, the expulsion direction of the screw unit is changed to an orientation corresponding to the detected tilt direction of the hull, and after the change in the expulsion direction is completed, expelling of the water current by the screw is started.

9. The planing boat according to claim 2, wherein if the tilt direction of the hull detected by the tilt sensor is maintained for a predetermined time, the expulsion direction of the screw unit is changed according to the detected tilt direction of the hull.

10. The planing boat according to claim 1, the planning boat further comprises:

a direction change mechanism provided between the hull and the screw unit, the direction change mechanism having a turning drive force source, wherein the screw unit changes the expulsion direction of the water current by drive force of the direction change mechanism.

11. The planing boat according to claim 2, wherein in a side view the hull is formed in a shape in which a peripheral part of the hull is curved upward from at a peripheral edge of the circular radially from the center.

12. The planing boat according to claim 6, wherein the first hull unit is provided at a central part of the hull.

13. The planing boat according to claim 6, wherein the screw unit entirely overlaps the first full unit in a plan view.

14. A planing boat comprising:

a hull having a boarding area;

a screw unit having a screw provided at the hull; and a tilt sensor that detects a tilt of the hull with respect to multiple horizontal directions, wherein an expulsion direction of the screw unit is matched in parallel with a tilt direction of the hull detected by the tilt sensor.

15. A planing boat comprising:

a hull having a boarding area;

a screw unit having a screw provided at the hull, and a tilt sensor that detects a tilt of the hull with respect to multiple horizontal direction, wherein a propulsion direction of the hull is matched in parallel with a tilt direction of the hull detected by the tilt sensor.

16. A planing boat comprising:

a hull having a boarding area;

a screw unit having a screw provided at the hull which has a boarding area, and the screw rotatably provided with respect to a plane parallel to the boarding area; and a tilt sensor that detects a tilt of the hull with respect to a horizontal direction, wherein an expulsion direction of the screw unit is matched in parallel with a tilt direction of the hull detected by the tilt sensor.

17. A planing boat comprising:

a hull having a boarding area;

a screw unit having a screw provided at the hull which has a boarding area, and the screw rotatably provided with respect to a plane parallel to the boarding area; and a tilt sensor that detects a tilt of the hull with respect to a horizontal direction, wherein a propulsion direction of the hull is matched in parallel with a tilt direction of the hull detected by the tilt sensor.

* * * * *